US009422646B2

(12) United States Patent
Matthies et al.

(10) Patent No.: US 9,422,646 B2
(45) Date of Patent: Aug. 23, 2016

(54) APPARATUS FOR PRODUCING ENTANGLEMENTS ON A MULTIFILAMENT THREAD

(75) Inventors: Claus Matthies, Ehndorf (DE); Jan Westphal, Schulp (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 443 days.

(21) Appl. No.: 14/005,786

(22) PCT Filed: Mar. 19, 2012

(86) PCT No.: PCT/EP2012/054744

§ 371 (c)(1),
(2), (4) Date: Nov. 26, 2013

(87) PCT Pub. No.: WO2012/130645

PCT Pub. Date: Oct. 4, 2012

(65) Prior Publication Data

US 2014/0090220 A1 Apr. 3, 2014

(30) Foreign Application Priority Data

Mar. 31, 2011 (DE) ..... 10 2011 015 689

(51) Int. Cl.
*D02G 1/16* (2006.01)
*D02J 1/08* (2006.01)

(52) U.S. Cl.
CPC .. *D02G 1/162* (2013.01); *D02J 1/08* (2013.01)

(58) Field of Classification Search
CPC ..... D02G 1/16; D02G 1/161; D02G 1/162; D02G 1/008; D02G 1/024; D02J 1/06; D02J 1/08
USPC ..... 28/271, 252, 276, 274, 275; 57/908, 57/350, 289, 293
See application file for complete search history.

(56) References Cited

U.S. PATENT DOCUMENTS 3,110,151 A * 11/1963 Bunting, Jr. ..... D02J 1/08 28/258
3,394,440 A * 7/1968 Van Holten ..... D02J 1/08 28/272
3,462,813 A * 8/1969 Dyer ..... D02G 1/16 28/273
3,848,404 A * 11/1974 London, Jr. ..... D02G 1/024 28/271
3,937,252 A * 2/1976 Ishida ..... F15B 21/125 137/624.13

(Continued)

FOREIGN PATENT DOCUMENTS

DE 19501309 A1 * 8/1995 ..... D02J 1/08
JP 2007092230 A 4/2007

OTHER PUBLICATIONS

English language machine translation of DE 4140469 (Jun. 1993), 6 pages.*

*Primary Examiner* — Amy Vanatta
(74) *Attorney, Agent, or Firm* — BainwoodHuang

(57) ABSTRACT

An apparatus for producing entanglements on a multifilament thread, has a treatment channel, has a nozzle bore that opens into the treatment channel and has an air supply device. The air supply device interacts with the nozzle bore in order to produce pulse-like compressed-air flows, wherein the compressed air is produced via a pressure chamber and a pressure source. In order in particular to control the pressure pulses produced in the pressure chamber, a volume store is arranged between the pressure chamber and the pressure source, wherein the volume store has a storage volume which is greater than a chamber volume of the pressure chamber.

10 Claims, 5 Drawing Sheets

(56) References Cited

Figure 1:
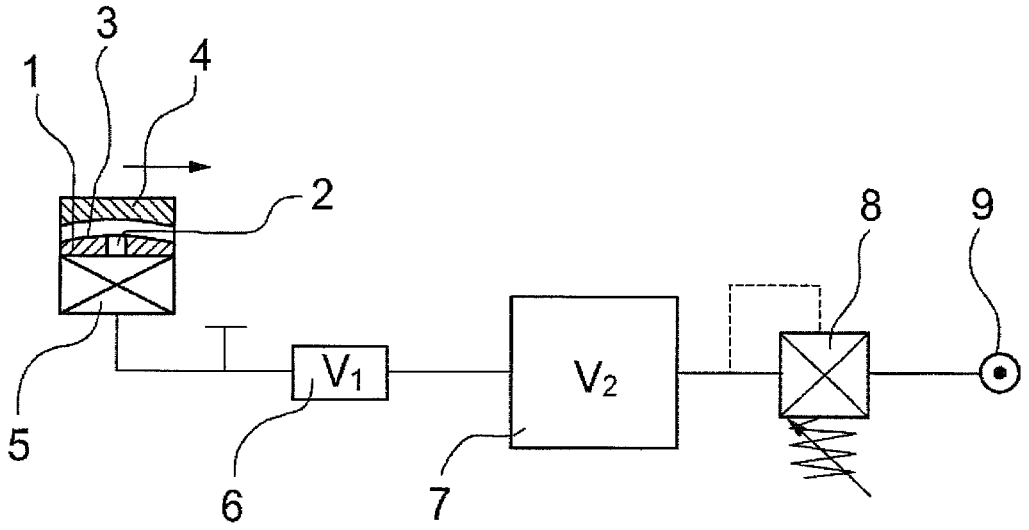

U.S. PATENT DOCUMENTS 4,058,960 A * 11/1977 Movshovich ..... D02G 3/286 137/624.13
4,215,642 A * 8/1980 Chambley ..... D02G 3/286 112/410
5,056,200 A 10/1991 Schwartz et al.
5,134,840 A 8/1992 Niederer et al.
5,763,076 A * 6/1998 Coons, III ..... D02G 1/16 426/399
6,089,009 A * 7/2000 Hand ..... D02G 1/161 57/282
2012/0144633 A1 * 6/2012 Kaulitzki ..... D02G 1/161 28/271

* cited by examiner

APPARATUS FOR PRODUCING ENTANGLEMENTS ON A MULTIFILAMENT THREAD

The invention relates to an apparatus for producing entanglements on a multifilament thread having a treatment channel, having a nozzle bore that opens into the treatment channel and having an air supply device which interacts with the nozzle bore in order to produce pulse-like compressed-air flows and which has a pressure chamber which is connected to a pressure source.

A generic apparatus for producing entanglements on a multifilament thread is known from U.S. Pat. No. 5,134,840.

In the production of synthetic threads, the latter are formed from a multiplicity of individual filament strands which, in order to be processed further, are connected to form thread cohesion by way of intertwining knots or entanglements. In order to produce such thread cohesion on the multifilament threads, it is known to produce the entanglements on the multifilament thread by way of a compressed-air treatment. Depending on the thread type and process, different treatment methods, from simple entanglement to the production of knots, can be achieved in this case. In principle, two types of compressed-air treatments of threads can be distinguished. In one variant, a continuous compressed-air flow is produced in a treatment channel via a nozzle bore, said compressed-air flow being directed substantially transversely to a continuously guided thread. However, such methods and apparatuses have the fundamental disadvantage that there is a permanent loss of compressed air and also relatively high pressures are necessary in order to obtain an intensification of the entanglement in the threads.

In a second variant of the compressed-air treatment, on which the invention is based, a pulse-like compressed-air flow is produced in the treatment channel via the nozzle bore. To this end, the nozzle bore is assigned an air supply device which, together with the nozzle bore, produces a pulse-like compressed-air flow in the treatment channel, said compressed-air flow being directed recurrently at the thread in a time sequence. An apparatus of this kind is known from the document cited above. To this end, the compressed-air supply device has a pressure chamber, which is used to feed the compressed air into the nozzle bore. The pressure chamber is connected to a pressure source, by way of which compressed air is directed into the pressure chamber. The pressure chamber is integrated in a hollow-cylindrical rotor which has a plurality of chamber openings on its circumference. The chamber openings can be connected alternately to a nozzle bore when the rotor is rotated, said nozzle bore opening into a treatment channel in which a thread is guided. When the rotor is rotated, a compressed-air flow is introduced in a pulse-like manner into the treatment channel via the nozzle bore in a time sequence, while a chamber opening communicates with the nozzle bore.

In the known apparatus, pulse-like pressure fluctuations occur within the pressure chamber, said pressure fluctuations propagating and leading to disruptions and noise in the compressed-air supply. Moreover, it has to be ensured that the pressure losses within the pressure chamber, which are caused during the production of a pulse-like compressed-air flow, are compensated for rapidly, in order that the subsequent compressed-air flow can be produced with the same intensity. Therefore, the known apparatus is suitable only for relatively slow thread running speeds in the region of 500 m/min.

It is therefore the object of the invention to provide an apparatus of the generic type for producing entanglements on a multifilament thread, by way of which threads can be treated at relatively high thread speeds in the region of above 2000 m/min.

A further aim of the invention is to develop the generic apparatus such that an undisrupted compressed-air supply is ensured even for relatively high operating pressures.

This object is achieved according to the invention in that a volume store is arranged between the pressure chamber and the pressure source, and in that the volume store has a storage volume which is greater than a chamber volume of the pressure chamber.

Advantageous developments of the invention are defined by the features and combinations of features disclosed herein.

The apparatus according to the invention has the particular advantage that the pressure pulses that occur in operation can be absorbed within the volume store and damped with respect to the compressed-air supply network. In addition, relatively large quantities of air are available for producing the pulse-like compressed-air flows, said quantities of air causing a relatively small pressure drop even in the case of relatively high operating pressures. Thus, even at relatively high operating pressures in the range of 6 to 10 bar, highly dynamic compressed-air flows can be produced for entangling a thread.

In order both to obtain high dynamics during the production of the compressed-air flows flowing through the nozzle bores and to produce high damping of the pressure pulses, the development of the invention, in which the storage volume of the volume store is greater by a multiple, preferably by a factor>20, than the chamber volume of the pressure chamber, has proven particularly successful. It is thus possible to assign the pressure chamber directly to the nozzle bore in a compact unit, so that short distances are possible for producing low-loss compressed-air flows.

In order that a substantially constant operating pressure can be maintained during a process, use is made in particular of the development of the invention in which a pressure regulator is arranged between the pressure source and the volume store. In this way, the compressed air can be maintained at a substantially constant operating pressure within the volume store. The level of the operating pressure is in this case determined substantially by the process and the thread type and also the thread titre. Usually, the operating pressure can be regulated by the pressure regulator to an approximately constant value, which may be in the range of 2 to 12 bar.

Depending on the nature of the surroundings in which the treatment of the thread for entangling has to be carried out, the volume store can be formed advantageously by a pressure vessel and/or a line section.

The link between the pressure chamber and the volume store is formed in this case advantageously by a very short connecting line having a length of <0.3 m, so that the pressure pulses within the pressure chamber that are generated during the production of the pulse-like compressed-air flows can be absorbed directly by the volume store.

In order that the pulse-like compressed-air flows produced in the nozzle bore can be produced at a high frequency at correspondingly high thread running speeds, in the apparatus according to the invention, the air supply device has preferably a rotating nozzle ring having a circumferential guide groove, in which guide groove the nozzle bore opens. The pressure chamber has a chamber opening, which is connectable briefly to the nozzle bore by rotation of the nozzle ring. The frequency for producing the compressed-air flows can thus be determined by rotation of the nozzle ring. The nozzle ring can in this case be driven via thread friction or by an external drive.

In order to form the treatment channel, a cover is assigned to the nozzle ring at a contact region between the guide groove and the thread. The contact region defines that zone on the nozzle ring in which the nozzle bore is connected to the chamber opening in the pressure chamber. To this extent, the cover represents at the same time a baffle plate in order to obtain the air guidance, which is necessary for producing entanglement, in the treatment channel.

Depending on the configuration of the pressure chamber, the nozzle ring can be configured in a hollow-cylindrical manner with a cylindrical sliding surface or in the form of a disc with an end-side sliding surface, said sliding surfaces interacting with corresponding sealing surfaces of a stator, in which the pressure chamber is configured with a chamber opening.

However, it is also possible to combine the air supply device with a treatment channel formed in a stationary manner. In this case, the pressure chamber is formed within a rotating rotor which has a chamber opening in its circumference. The rotor is enclosed by a cylindrical stator which has in one region the nozzle bore having an integrated treatment channel. The stator has an internal sealing surface, which interacts with an external sliding surface of the rotor. In this way, too, very short distances between the nozzle bore and the pressure chamber can be realized, so that low pressure losses occur during the production of the pulse-like compressed-air flows. In this way, it is possible to produce highly dynamic compressed-air shocks which can be used preferably for producing intertwining knots in a multifilament thread.

Figure 2:
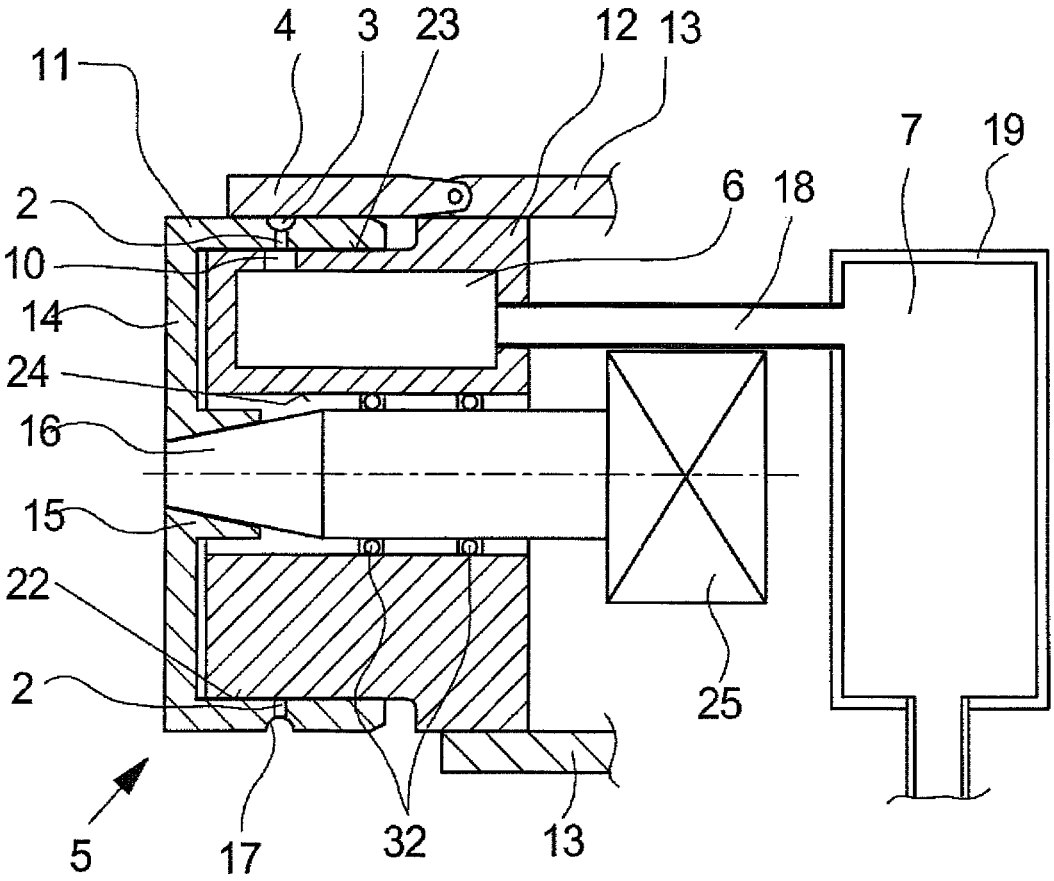
Figure 3:
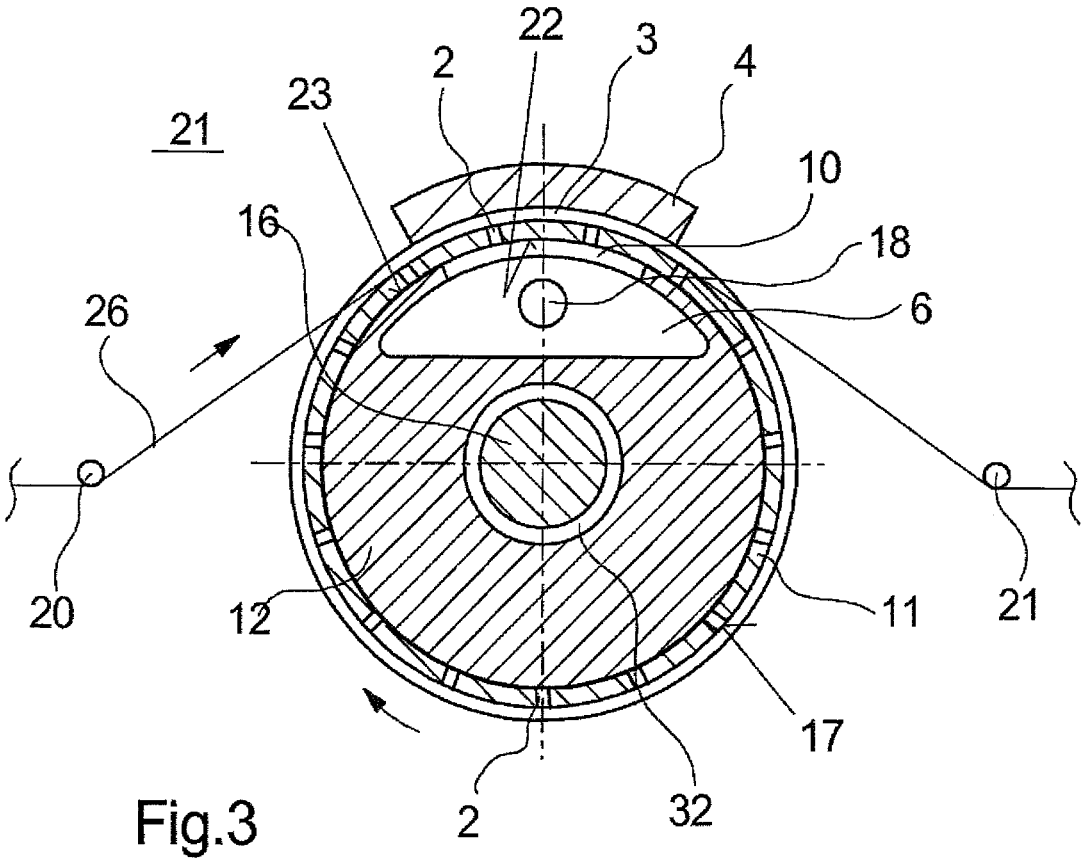
Figure 4:
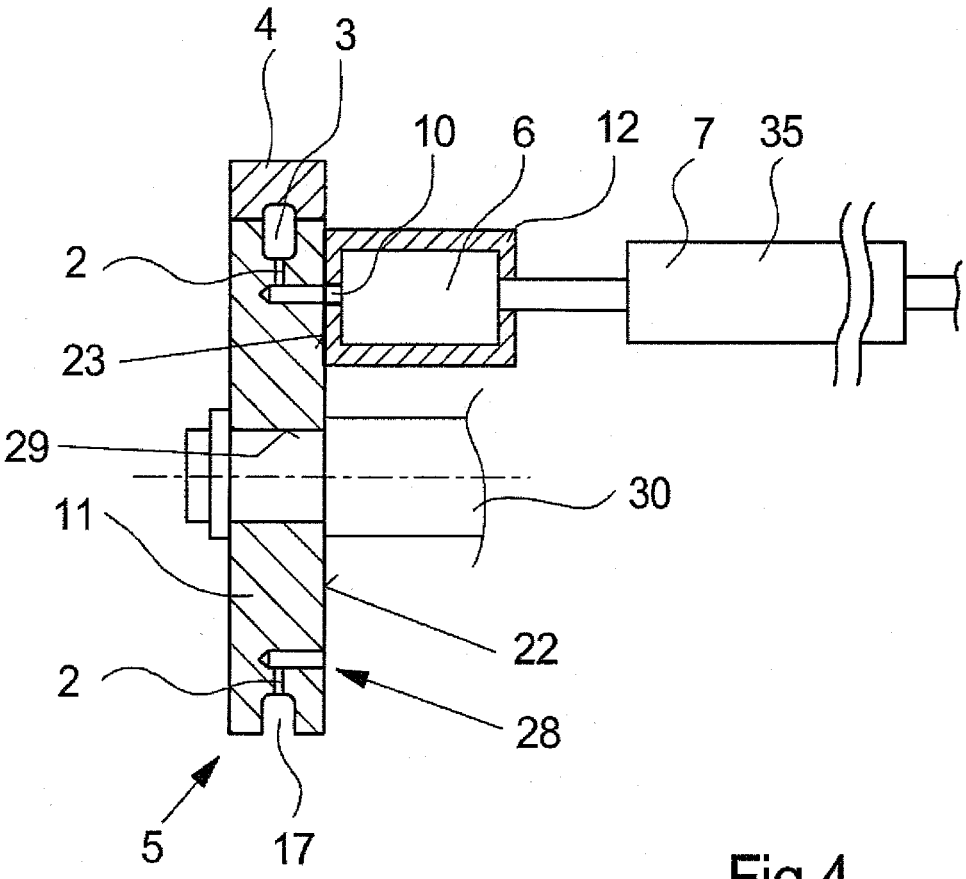
Figure 5:
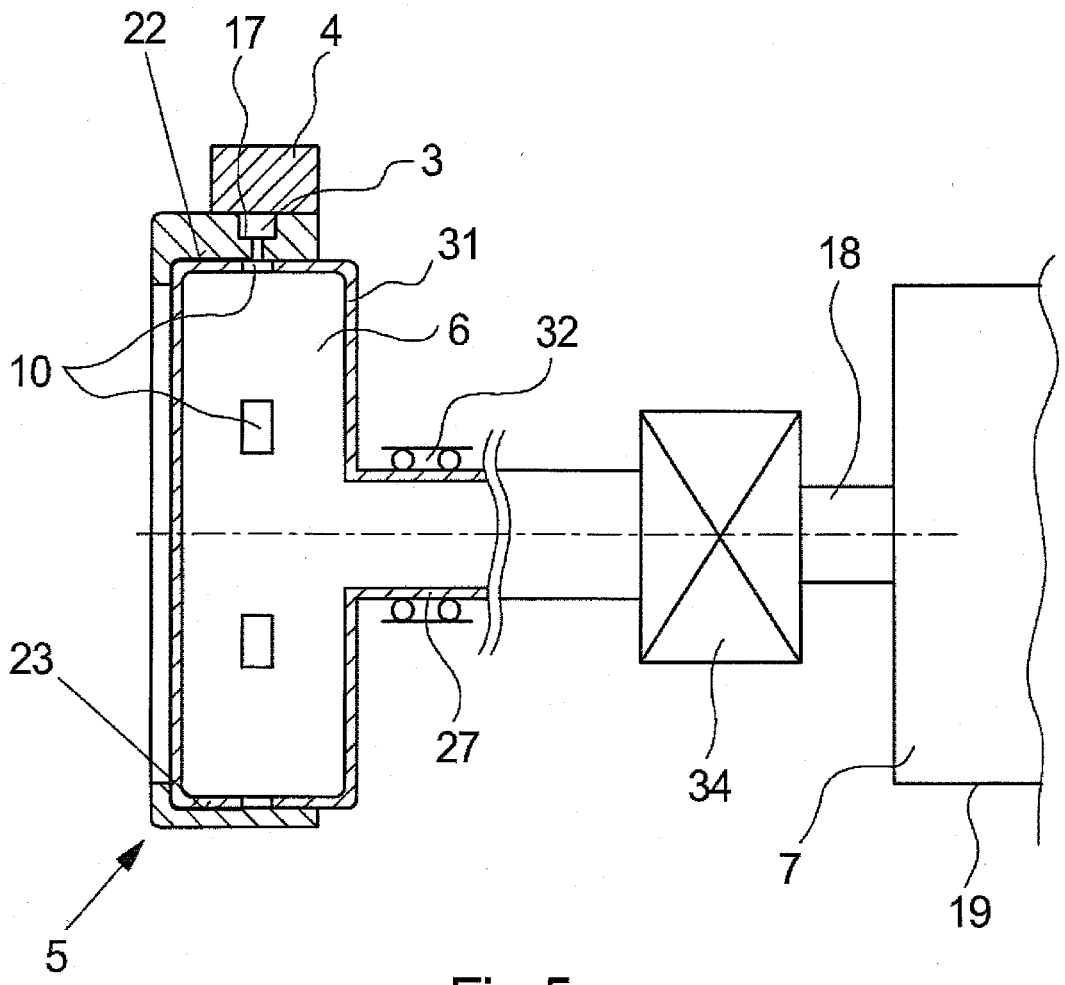

The apparatus according to the invention is particularly suitable for producing a large number of stable and pronounced entanglements and intertwining knots on multifilament threads at thread speeds of above 2000 m/min. The apparatus according to the invention is explained in more detail in the following text on the basis of a number of exemplary embodiments and with reference to the appended figures, in which:

FIG. 1 shows a schematic diagram of the apparatus according to the invention, FIG. 2 schematically shows a longitudinal sectional view of a first exemplary embodiment of the apparatus according to the invention, FIG. 3 schematically shows a cross-sectional view of the exemplary embodiment from FIG. 2, FIG. 4 schematically shows a longitudinal sectional view of a further exemplary embodiment of the apparatus according to the invention, FIG. 5 schematically shows a longitudinal sectional view of a further exemplary embodiment of the apparatus according to the invention.

FIG. 1 shows a schematic diagram of the apparatus according to the invention for producing entanglements on a multifilament thread. A thread is treated in this case within a treatment channel 3, which is formed between a nozzle support 1 and a cover 4. Provided on the nozzle support 1 is a nozzle bore 2, one end of which opens in the treatment channel 3 and the other end of which is connected to an air supply device 5. The air supply device 5 is not illustrated in more detail here and is explained in more detail in the following exemplary embodiments.

The air supply device 5 is assigned a pressure chamber 6 and a volume store 7. The pressure chamber 6 has a chamber volume which is designated by the reference sign $V_1$ in FIG. 1. The volume store 7 has, by contrast, a much larger storage volume, which is designated by the reference sign $V_2$ in FIG. 1.

On an inlet side, the volume store 7 is connected to a pressure source 9 via a pressure regulator 8.

In operation, the pressure source 9 is activated, and so the volume store 7 and the pressure chamber 6 are filled with compressed air. The pressure regulator 8 ensures in this case that a predetermined operating pressure is maintained in the volume store 7 and the pressure chamber 6.

In order to treat a thread guided through the treatment channel 3 with a pulse-like compressed-air flow in a recurrent manner, a connection between the nozzle bore 2 and the pressure chamber 6 is established briefly via the air supply device 5. In this case, during the opening time of the nozzle bore 2, a pulse-like compressed-air flow is produced and introduced into the treatment channel 3 for thread treatment. In order to obtain low losses and short reaction times, the pressure chamber 6 is arranged preferably in the immediate vicinity of the nozzle bore 2. The compressed-air flows, which are produced at a determined frequency, cause pressure pulses within the pressure chamber 6, said pressure pulses propagating to the volume store 7 and being substantially damped there on account of a substantially larger storage volume, so that scarcely any or only small pressure pulses are perceptible on the inlet side of the volume store 7.

In the apparatus according to the invention, it has emerged that the chamber volume $V_1$ and the storage volume $V_2$ should have a minimum ratio, in order to obtain sufficient damping at the usual operating positive pressures, which could be in the range of 2 to 12 bar. In particular, it should in this case be taken into consideration that the chamber volume $V_1$ of the pressure chamber 6 must have a particular size in order that a high density of entanglement points can be produced on the thread at high thread running speeds of above 2000 m/min. Thus, after a compressed-air flow has been produced, the operating pressure in the pressure chamber 6 has to have reached its original value as far as possible before the next compressed-air flow is achieved. Thus, it has emerged that between the storage volume and the chamber volume there should be a ratio of $V_2N_1 \geq 20$. To this extent, the storage volume $V_2$ of the volume store 7 is greater by a multiple than the chamber volume $V_1$ of the pressure chamber 6.

In order to produce a large number of intertwining knots on a synthetic thread at relatively high thread speeds, the apparatus according to the invention is advantageously configured as per the exemplary embodiment illustrated in FIGS. 2 and 3. FIG. 2 shows a longitudinal sectional view of the exemplary embodiment and FIG. 3 shows a cross-sectional view of the exemplary embodiment.

In so far as no express reference is made to either of the figures, the following description applies to both figures.

In the exemplary embodiment of the apparatus according to the invention for producing entanglement on a multifilament thread there is provided an air supply device 5, which has as nozzle support a rotating nozzle ring 11 which is configured in an annular manner and has a circumferential guide groove 17 at its circumference. In the bottom of the guide groove 17 there open a plurality of nozzle bores 2, which are formed in a manner distributed uniformly around the circumference of the nozzle ring 11. The nozzle bores 2 penetrate through the nozzle ring 11 as far as an inner sliding surface 22.

The nozzle ring 11 is connected to a driveshaft 16 via an end-side end wall 14 and a hub 15, which is arranged centrally on the end wall 14. To this end, the hub 15 is fastened to a free end of the driveshaft 16.

The cylindrical inner sliding surface 22 of the nozzle ring 11 is guided in the form of a sheath on a guide portion of a stator 12, which forms a cylindrical sealing surface 23 opposite the sliding surface 22. The stator 12 has a chamber opening 10 at one position on the circumference of the cylindrical sealing surface 23, said chamber opening 10 being connected to a pressure chamber 6 formed inside the stator 2. The pressure chamber 6 is connected via a connecting line 18 to a volume store 7, which in this exemplary embodiment is in the form of a pressure vessel 19. In this case, the connecting line 18 is embodied to be very short between the pressure chamber 6 and the pressure vessel 19, in order to obtain direct interaction of the two volumes. The connecting line 18 preferably has in this case a length which is less than 0.3 m.

The chamber opening 10 on the stator 12 and the nozzle bores 2 on the nozzle ring 11 are formed in a plane, so that the nozzle bores 2 are guided in the region of the chamber opening 10 by rotation of the nozzle ring 11. To this end, the chamber opening 10 is configured as a slot and extends in the radial direction over a relatively long guide region of the nozzle bores 2. The size of the chamber opening 10 thus determines an opening time of the nozzle bores 2, while the latter produce a compressed-air pulse. The sliding surface 22 of the nozzle ring 11 and the sealing surface 23 of the stator 12 form a sealing gap in order to avoid pressure losses in the pressure chamber 6.

The stator 12 is held on a support 13 and has a central bearing bore 24, which is formed concentrically with the cylindrical sealing surface 23. Within the bearing bore 24, the driveshaft 16 is mounted in a rotatable manner by the bearings 32.

The driveshaft 16 is coupled at one end to an electric motor 25, by way of which the nozzle ring 11 can be driven at a predetermined circumferential speed. To this end, the electric motor 25 is arranged on the side of the stator 12.

As can be seen from the illustration in FIG. 2, a cover 4 is assigned to the circumference of the nozzle ring 11, said cover 4 being held in a movable manner on the support 13 via a pivot pin. Alternatively, the cover 4 could also be held in a stationary manner, if, in order to lay a thread, a threading slit were formed between the cover 4 and the nozzle ring 11.

As can be seen from the illustration in FIG. 3, the cover 4 extends in the radial direction at the circumference of the nozzle ring 11 over a region which encloses the chamber opening 10 in the stator 12 on the inside. On its side facing towards the nozzle ring 11, the cover 4 has an adapted covering surface, which covers the guide groove 17 to form a treatment channel 3. Within the treatment channel 3, a thread 26 is guided in the guide groove 17 at the circumference of the nozzle ring 11. To this end, an inlet thread guide 20 is assigned to a run-in side and an outlet thread guide 21 is assigned to a run-off side in the nozzle ring 11. The thread 26 can thus be guided between the inlet thread guide 20 and the outlet thread guide 21 with a partial looping on the nozzle ring 11 in a contact region.

In the exemplary embodiment illustrated in FIGS. 2 and 3, in order to produce entanglements on the multifilament thread 26, compressed air is provided through the pressure chamber 6 and the pressure vessel 19. The nozzle ring 11, which guides the thread 26 in the guide groove 17, produces continuous compressed-air pulses as soon as the nozzle bores 2 pass into the region of the chamber opening 10. In this case, the pressure pulses lead to local entanglements on the multifilament thread 26 so that a multiplicity of entangling knots are formed on the thread. The chamber volume of the pressure chamber 6 and also the storage volume of the pressure vessel 19 are in this case coordinated with the respective process and the respectively necessary operating pressure. To this end, a pressure regulator, which is not illustrated in more detail here, is assigned likewise to the inlet side of the pressure vessel 19.

FIG. 4 schematically shows a longitudinal sectional view of a further exemplary embodiment of the apparatus according to the invention having an alternatively configured air supply device 5. In this case, the nozzle support is formed likewise by a rotating nozzle ring 11, which is in the form of a disc and has a guide groove 17 at its circumference, said guide groove 17 encompassing the nozzle ring 11 in the radial direction. A plurality of nozzle bores 2 open in the bottom of the guide groove 17. The nozzle bores 2 formed in the nozzle ring 11 each have two nozzle bore portions, wherein a first portion is oriented radially and opens into the bottom of the guide groove 17 and the second bore portion is oriented axially and opens at an end side 28 of the nozzle ring 11. On the end side 28 of the nozzle ring 11 there is formed a sliding surface 22 in which the nozzle bore 2 opens. Held in an upper region of the nozzle ring 11 is a stationary stator 12, which is held by way of a planar sealing surface 23 on the end-side sliding surface 22 of the nozzle ring 11 via a sealing gap. Formed within the stator 12 is a pressure chamber 6, which is coupled to a volume store 7 via a connecting line 18. In this exemplary embodiment, the volume store 7 is formed by a line section 35 having an enlarged flow cross section. The line section 35 is coupled on an inlet side to a pressure regulator, which is not illustrated here, and a pressure source.

Formed on the planar sealing surface 23 of the stator 12 is a chamber opening 10, which represents an outlet to the pressure chamber 6. In this case, the chamber opening 10 extends over an opening angle which determines the opening time of the nozzle bores 2 when the nozzle ring 11 is rotated.

Above the stator 12, a movable cover 4 is assigned to the nozzle ring 11 and can be guided back and forth between a covering position and open position, which is not illustrated here. The cover 4 forms, together with the nozzle ring, the treatment channel 3 in which a thread is guided.

By rotation, the nozzle ring 11 is held on the circumference of a bearing pin 30 by a centrally arranged holding bore 29. The bearing pin 30 is mounted in a rotatable manner on a machine frame, which is not illustrated here.

The function of the exemplary embodiment illustrated in FIG. 4 of the apparatus according to the invention is identical to the previous exemplary embodiment according to FIGS. 2 and 3, and so reference is made at this point to the above description and no further details are given here.

FIG. 5 shows a further exemplary embodiment of the apparatus according to the invention having a further alternative configuration of the air supply device 5. The exemplary embodiment in FIG. 5 is shown schematically in a longitudinal sectional view.

The compressed air is supplied to a nozzle bore 2 in this case through a rotatably mounted rotor 31, which is formed in a hollow-cylindrical manner and forms a pressure chamber 6 on the inside. On its circumference, the rotor 31 has a cylindrical sliding surface 22, which interacts with an opposing sealing surface 23 of a housing 33. On a circumferential portion, the housing 33 has a tangentially extending guide groove 17, in the bottom of which the nozzle bore 2 opens. The nozzle bore 2 penetrates through the housing 33 as far as the inner sealing surface 23.

In the plane of the nozzle bore 2, the rotor 31 has on its circumference a plurality of chamber openings 10, which are arranged in a distributed manner and are supplied alternately with the nozzle bore 2 when the rotor 31 is rotated.

The chamber openings 10 connected to the nozzle bore 2 are sealed off by the sealing surface 23 of the housing 33.

The guide groove 17 in the housing 33 is assigned a cover 4, by way of which the treatment channel 3 is formed. Thus, within the treatment channel 3, there is guided a thread, which is entangled by the compressed-air flows produced in a pulse-like manner at the nozzle bore 2. The cover 4 is configured in a movable manner in this exemplary embodiment, too, in order to enable the thread to be laid before the start of the process.

As already explained in the preceding exemplary embodiments, the pressure chamber 6 is coupled here, too, to a volume store 7. To this end, the rotor 31 has a hollow-cylindrical driveshaft 27, which is mounted in a rotatable manner on a bearing 32 and is coupled to a drive, which is not illustrated here. At one end, the driveshaft 27 is connected to the pressure vessel 19 via an air connection 34. The air connection 34 contains a rotary transmitter so that compressed air can be guided into the interior of the hollow shaft 27.

The exemplary embodiment illustrated in FIG. 5 of the apparatus according to the invention thus shows a further design configuration of the possible air supply device, in order to produce a pulse-like compressed-air flow at a nozzle bore. A common feature of all the exemplary embodiments illustrated here is that the pressure chamber 6 is assigned directly to the nozzle bore 2 in order to produce the pressure pulses. In this case, very short distances are realized between the treatment channel and the pressure chamber, so that very pronounced thread treatment is possible.

However, it should expressly be mentioned at this point that the invention also comprises similar or alternative design variants of the air supply device 5, which are not illustrated here. Thus, for example, the pulse-like delivery of the compressed air to a nozzle bore could take place by way of valve control.

Furthermore, in each of the exemplary embodiments shown, a treatment channel for treating a thread is illustrated. In principle, the apparatuses shown can also be used advantageously for treating a plurality of threads parallel to and alongside one another. To this end, it is possible for each treatment channel to be assigned a separate pressure chamber from a plurality of pressure chambers, which are connected jointly to a volume store. However, it is also possible for a plurality of treatment channels alongside one another to be supplied by one pressure chamber.

LIST OF REFERENCE SIGNS

1 Nozzle support
2 Nozzle bore
3 Treatment channel
4 Cover
5 Air supply device
6 Pressure chamber
7 Volume store
8 Pressure regulator
9 Pressure source
10 Chamber opening
11 Nozzle ring
12 Stator
13 Support
14 End wall
15 Hub
16 Driveshaft
17 Guide groove
18 Connecting line
19 Pressure vessel
20 Inlet thread guide
21 Outlet thread guide
22 Sliding surface
23 Sealing surface
24 Bearing bore
25 Electric motor
26 Thread
27 Relief groove
28 End side
29 Holding bore
30 Bearing pin
31 Rotor
32 Bearing
33 Housing
34 Air connection
35 Line section

The invention claimed is:

1. Apparatus for producing entanglements on a multifilament thread, having a treatment channel, having a nozzle bore that opens into the treatment channel and having an air supply device which interacts with the nozzle bore in order to produce pulsed compressed-air flows and which apparatus has a pressure chamber which is connected to a pressure source, wherein a volume store is arranged between the pressure chamber and the pressure source, wherein the volume store has a storage volume which is greater than a chamber volume of the pressure chamber, wherein the air supply device has a rotating rotor which forms the pressure chamber on its inside and which has a chamber opening at its circumference on a sliding surface, and wherein the nozzle bore and the treatment channel are formed on a housing which encloses the rotor and has an inner sealing surface, wherein the chamber opening is connectable alternately to the nozzle bore when the rotor is rotated.

2. Apparatus according to claim 1, wherein the storage volume of the volume store is greater by a multiple than the chamber volume of the pressure chamber.

3. Apparatus according to claim 1, wherein a pressure regulator is arranged between the pressure source and the volume store.

4. Apparatus according to claim 1, wherein the volume store is formed by at least one of a pressure vessel and a line section.

5. Apparatus according to claim 1, wherein the pressure chamber and the volume store are connected by a short connection line having a length of less than 0.3 m.

6. Apparatus according to claim 2, wherein the storage volume of the volume store is greater by a factor>20 than the chamber volume of the pressure chamber.

7. Apparatus for producing entanglements on a multifilament thread, having a treatment channel, having a nozzle bore that opens into the treatment channel and having an air supply device which interacts with the nozzle bore in order to produce pulsed compressed-air flows and which apparatus has a pressure chamber which is connected to a pressure source, wherein a volume store is arranged between the pressure chamber and the pressure source, wherein the volume store has a storage volume which is greater than a chamber volume of the pressure chamber, wherein the air supply device has a rotating nozzle ring having a circumferential guide groove, wherein the nozzle bore opens into the guide groove, wherein the pressure chamber has a chamber opening, which is connectable to the nozzle bore by rotation of the nozzle ring, wherein the pressure chamber is formed on a stator having a cylindrical sealing surface in which the chamber opening opens, and wherein, in order to transmit compressed air, a sliding surface of the nozzle ring interacts with the sealing surface of the stator.

8. Apparatus according to claim 7, wherein a cover is disposed in a contact region between the guide groove and a thread, the treatment channel being formed by said cover.

9. Apparatus for producing entanglements on a multifilament thread, having a treatment channel, having a nozzle bore that opens into the treatment channel and having an air supply device which interacts with the nozzle bore in order to produce pulsed compressed-air flows and which apparatus has a pressure chamber which is connected to a pressure source, wherein a volume store is arranged between the pressure chamber and the pressure source, and wherein the volume store has a storage volume which is greater than a chamber volume of the pressure chamber, wherein the air supply device has a rotating nozzle ring having a circumferential guide groove, wherein the nozzle bore opens into the guide groove, wherein the pressure chamber has a chamber opening, which is connectable to the nozzle bore by rotation of the nozzle ring, wherein the nozzle ring is configured in the form of a disc having an end-side sliding surface in which the nozzle bore opens axially, wherein the pressure chamber is formed on a stator having a planar sealing surface in which the chamber opening opens, and wherein, in order to transmit compressed air, the end-side sliding surface of the nozzle ring interacts with the sealing surface of the stator.

10. Apparatus according to claim 9, wherein a cover is disposed in a contact region between the guide groove and a thread, the treatment channel being formed by said cover.

* * * * *